United States Patent [19]

Tateishi

[11] Patent Number: 4,742,748

[45] Date of Patent: May 10, 1988

[54] ELECTRONIC MUSICAL INSTRUMENT ADAPTED FOR SOUNDING RHYTHM TONES AND MELODY-TONES ACCORDING TO RHYTHM AND MELODY PLAY PATTERNS STORED IN A TIMED RELATION TO EACH OTHER

[75] Inventor: Naofumi Tateishi, Tokyo, Japan

[73] Assignee: Casio Computer Co., Ltd., Tokyo, Japan

[21] Appl. No.: 945,082

[22] Filed: Dec. 22, 1986

[30] Foreign Application Priority Data

Dec. 31, 1985 [JP] Japan ..... 60-298989

[51] Int. Cl.[4] ..... G10H 1/42; G10H 7/00

[52] U.S. Cl. ..... 84/1.03; 84/1.28; 84/477 R; 84/DIG. 12

[58] Field of Search ..... 84/1.03, 1.01, 1.28, 84/477 R, 478, DIG. 12

[56] References Cited

U.S. PATENT DOCUMENTS 4,633,751 1/1987 Fukaya ..... 84/1.03

*Primary Examiner*—S. J. Witkowski

*Attorney, Agent, or Firm*—Frishauf, Holtz, Goodman & Woodward

[57] ABSTRACT

An electronic musical instrument comprises devices for inputting rhythm and melody play patterns. The rhythm and melody play patterns are stored in a pattern memory such that the rhythm and melody play patterns are in a timed relation to each other. The rhythm and melody play patterns are simultaneously read out from said pattern memory so that rhythm tones and melody tones are sounded according to the rhythm and melody play patterns.

4 Claims, 19 Drawing Sheets

| | CH 1 | CH 2 | CH 3 | CH 4 |
|---|---|---|---|---|
| 01 | BASS DRUM | SNARE DRUM | CLOSED HI-HAT | LOW BONGO |
| 10 | LOW TOM-TOM | RIM SHOT | OPEN HI-HAT | HIGH BONGO |
| 11 | HIGH TOM-TOM | HAND CLAP | RIDE CYMBAL | AGOGO |

ELECTRONIC MUSICAL INSTRUMENT ADAPTED FOR SOUNDING RHYTHM TONES AND MELODY-TONES ACCORDING TO RHYTHM AND MELODY PLAY PATTERNS STORED IN A TIMED RELATION TO EACH OTHER

BACKGROUND OF THE INVENTION

This invention relates to an electronic musical instrument, in which play pattern data are stored and an automatic performance is carried out according to the stored play pattern data.

Heretofore, an electronic musical instrument has been realized, in which a rhythm play pattern is input using a keyboard or the like so that the input rhythm play pattern data is stored, and it is then read out, in response to a rhythm automatic play command, to sound successive rhythm tones with a designated tone color.

With this instrument, a rhythm pattern can be freely set by a player. However, it is possible to play only rhythm tones, and melody tones cannot be used as constituent tones of the rhythm. In other words, a melody pattern cannot be input in combination with a rhythm pattern.

SUMMARY OF THE INVENTION

An object of the invention is to provide an electronic musical instrument, which permits melody tones to be automatically sounded as constituent tones of a rhythm pattern.

Another object of the invention is to provide an electronic musical instrument, which permits only particular rhythm or melody tones in rhythm or melody patterns to be extracted for sounding as well as permitting melody tones to be sounded as constituent tones of a rhythm pattern.

A further object of the invention is to provide an electronic musical instrument which permits the status of sounding of a rhythm pattern to be confirmed visually, as well as permitting melody tones to be sounded as constituent tones of a rhythm pattern.

A further object of the invention is to provide an electronic musical instrument which permits effective use of musical tone generation channels, as well as permitting melody tones to be sounded as constituent tones of a rhythm pattern.

According to the invention, there is provided an electronic musical instrument comprising rhythm pattern input means for inputting a rhythm play pattern; melody pattern input means for inputting a melody play pattern; pattern memory means for storing rhythm and melody patterns provided by the rhythm and melody input means as a single rhythm pattern, such that the rhythm and melody patterns are combined in a timed relation to the progress of a musical piece; readout means for simultaneously reading the rhythm and melody patterns from the pattern memory means; and melody and rhythm tone generating means for generating rhythm and melody tones according to the melody and rhythm pattern data read out by the readout means.

DETAILED DESCRIPTION OF THE PREFERRED EMBODIMENT

An electronic musical instrument embodying the invention will be described with reference to the drawings.

Construction of Operation Panel of the Musical Instrument

Figure 1A:
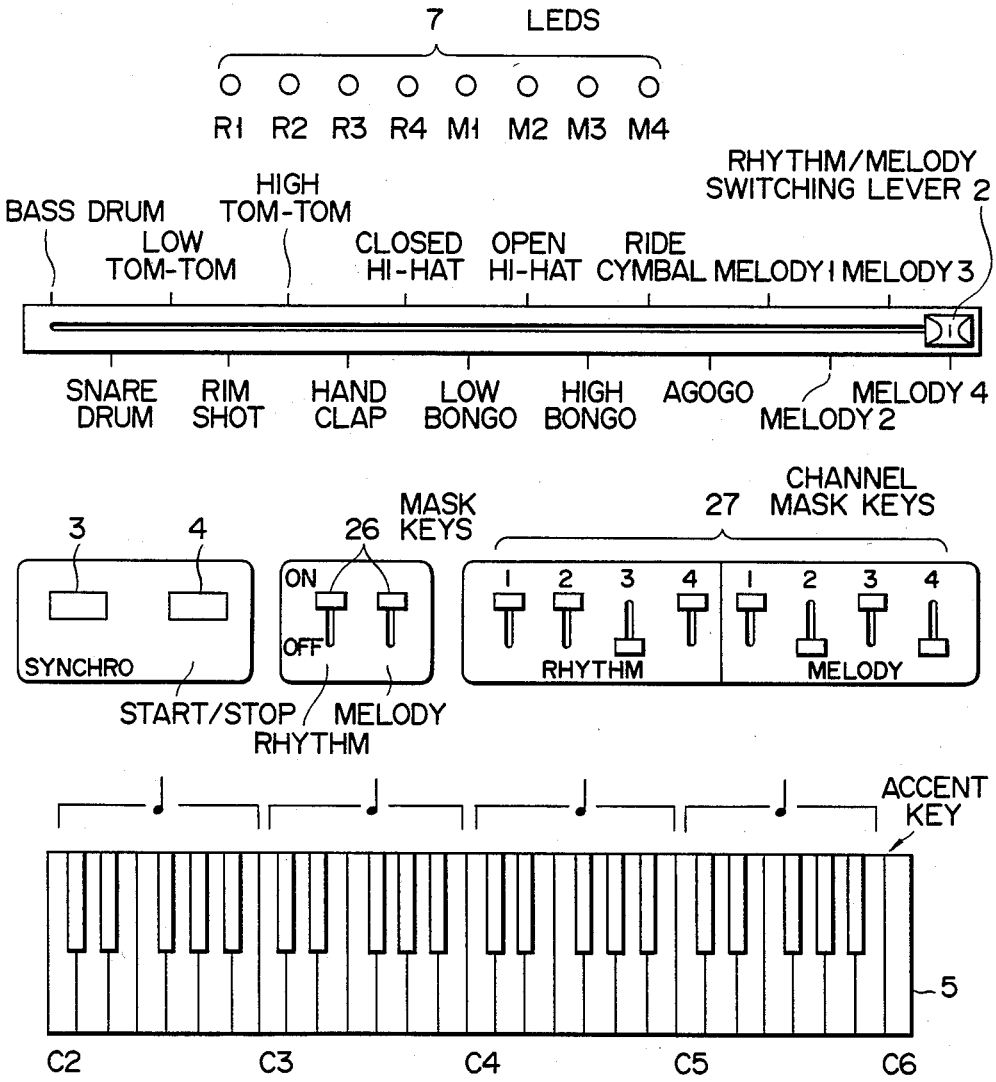
FIGS. 1A and 1B show, in combination, various switches and a display section provided on a panel of an electronic musical instrument according to the invention.
Figure 1B:
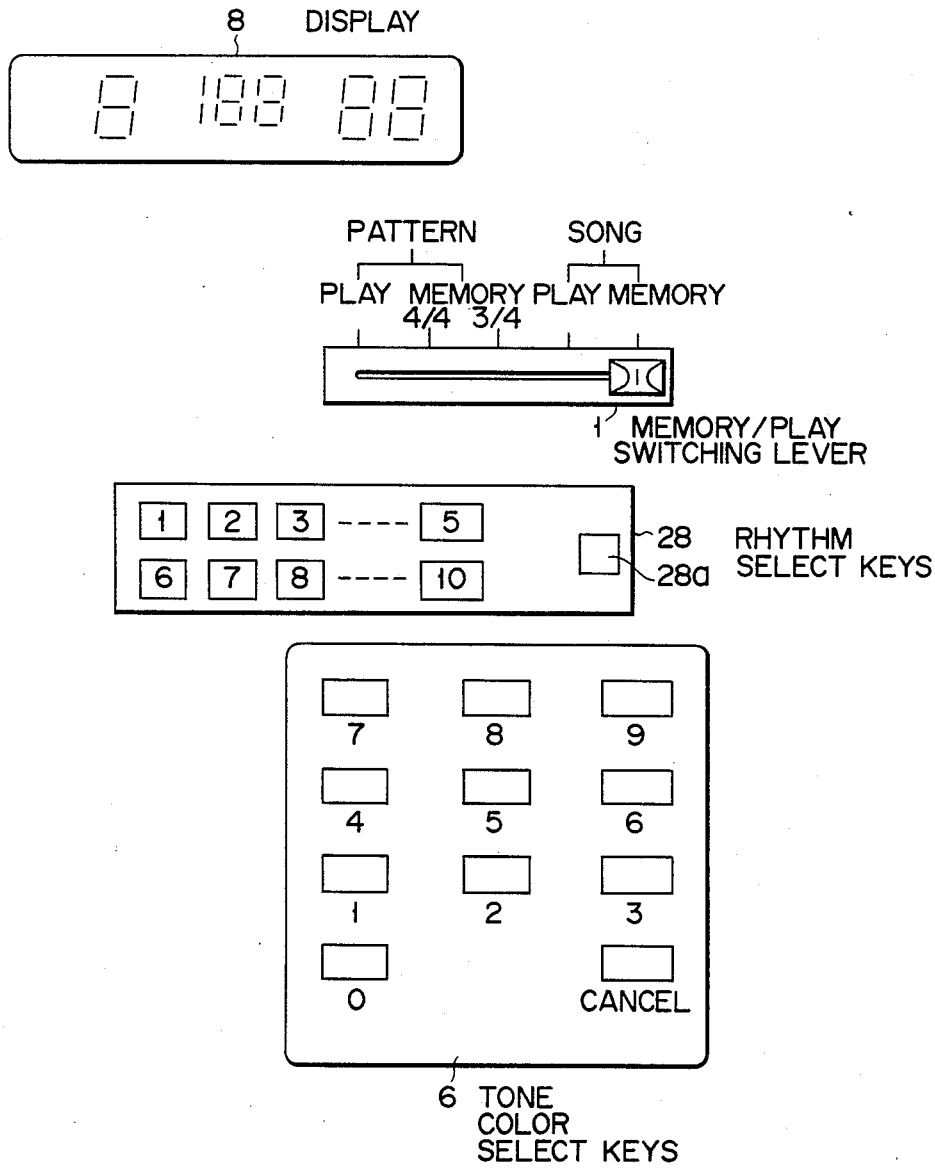

FIGS. 1A and 1B show a rhythm/melody pattern input section provided on the panel of the electronic musical instrument. Reference numeral 1 designates a memory/play switching lever. Either a pattern play mode, a pattern memory mode, a song play mode or a song memory mode may be set by operating the lever. In the pattern memory mode for 4/4 or $\frac{3}{4}$ time, a rhythm or melody pattern for one bar at 4/4 or $\frac{3}{4}$ time can be set. In this embodiment, it is possible to set a maximum of 20 different rhythm and melody patterns. In the pattern play mode, the rhythm or melody pattern of one bar is automatically played. In the song memory mode, the stored rhythm or melody patterns may be combined in a desired order. In the song play mode, the combined patterns are "autoplayed".

Rhythm/melody switching lever 2, which is provided beside memory/play switching lever 1, is arranged to specify a timbre of a rhythm pattern or a melody type of a melody pattern stored in the pattern memory mode. Synchro key 3, shown beneath rhythm-/melody switching lever 2, is adapted for starting the play of the stored rhythm and melody patterns in synchronism with the depression of a key on keyboard 5, to be described later. Start/stop key 4 is adapted to start and stop the rhythm and melody pattern autoplay. In the pattern memory mode, keyboard 5 can be used for providing melody pattern data for one bar by turning on the start/stop switch after a tone pitch has been designated on the keyboard.

Keyboard 5 has 49 keys (notes C2 to C6), and, in the pattern memory mode, one-beat sounding timing data can be provided by 12 keys for one octave and a timing pattern for one bar by 48 keys. Further, in the melody pattern memory mode, pitches of C2 to C6 of melody tones can be designated by respective keys. The last, i.e., 49-th, key is used to designate an accentuating tone. Shown under memory/play switching lever 1 are tone color select keys 6, for designating a tone color of a melody pattern as a numerical value. A cancel key is provided in addition to melody tone color keys 6. Rest data can be provided by depressing the cancel key simultaneously with a key on keyboard 5 that corresponds to the timing of a rest in a bar.

Respectively shown above rhythm/melody switching lever 2 and memory/play switching lever 1 are eight LEDs 7, i.e., R1 to R4 and M1 to M4, and a numerical display section 8. When rhythm and melody patterns are sounded in the respective four channels, LEDs R1 to R4 and M1 to M4 are lit for the respective channels. Display section 8 displays the number of tones sounded simultaneously, the number of a key operated when setting a rhythm or melody pattern (digits 1, 2, . . . , 48 being allotted to respective keys from the key of C2), and a tone color number set by a tone color select key.

Shown under rhythm/melody switching lever 2 are collective mask keys 26 and individual mask keys 27. A collective mask key collectively stops the sounding the rhythm or melody patterns. Individual mask keys 27 independently stop the sounding the rhythm or melody patterns for respective channels. Rhythm select keys 28 are provided for designating one of 20 memory areas of a pattern memory when storing a rhythm or melody pattern in the pattern memory. When switch **28*a* is off, one of the 1st to 10th memory areas is selected with a corresponding rhythm select key. When switch 28*a*** is turned on, one of the 11th to 21st memory areas can be designated.

Circuit Arrangement

Figure 2:
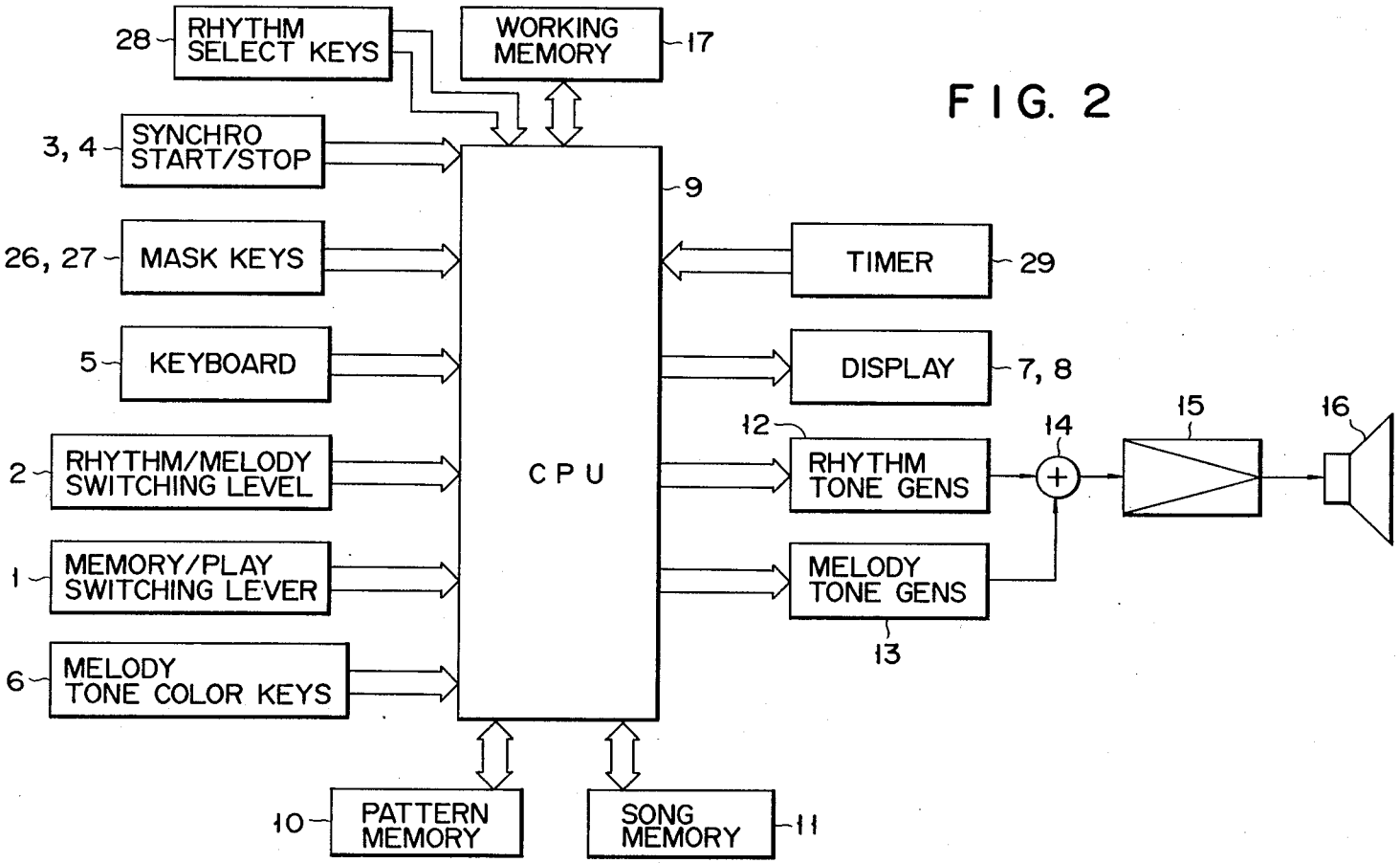
FIG. 2 is a block diagram of an arrangement of the electronic musical instrument.

Referring now to FIG. 2, which shows the arrangement of the electronic musical instrument, rhythm or melody pattern data for one bar input from keyboard 5 is written by CPU 9 into pattern memory 10. Combination pattern data of rhythm or melody patterns is written into song memory 11. Rhythm and melody pattern data read out from pattern memory 10 is supplied to a rhythm tone generator 12, and also to a melody tone generator 13. These generators generate rhythm and melody tone signals which are mixed in a mixer 14 and then amplified by amplifier 15, to be sounded by loudspeaker 16.

Rhythm tone generator 12 comprises four tone generation channels. Melody tone generator 13 has eight tone generation channels, which are utilized for a polyphonic performance on keyboard 5. When a melody pattern is played, four of the eight channels (i.e., the 1st to 4th channels) are allotted to keyboard 5, while the remaining four channels (i.e., the 5th to 8th channels) are allotted to melody pattern. The operation of each of collective and individual mask keys 26 and 27 is detected by CPU 9, and data "1" is set to a corresponding bit of a pattern sounding mask register RMKF in working memory 17. As a result, the generation of rhythm and melody tones in mask-designated channels is inhibited by rhythm and melody tone generators 12 and 13 in the rhythm and melody pattern play mode.

Working memory 17 is used for the processing of setting and reading of the rhythm and melody patterns described above.

Construction of Pattern Memory 10 and Working Memory 17

Figure 3:
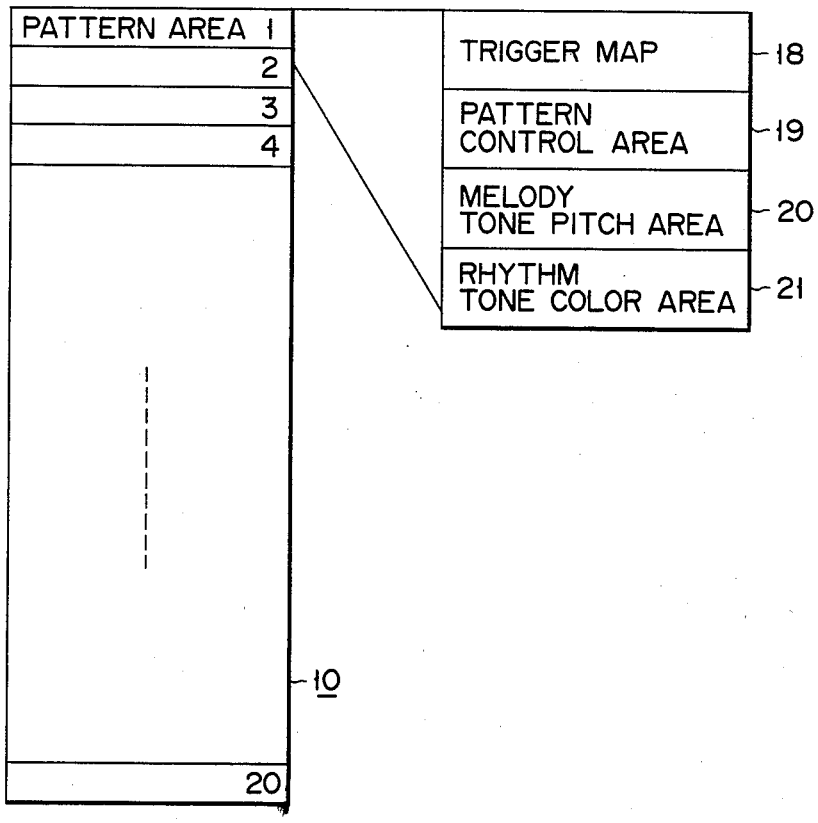
FIG. 3 shows an arrangement of a pattern memory 10.
Figure 4:
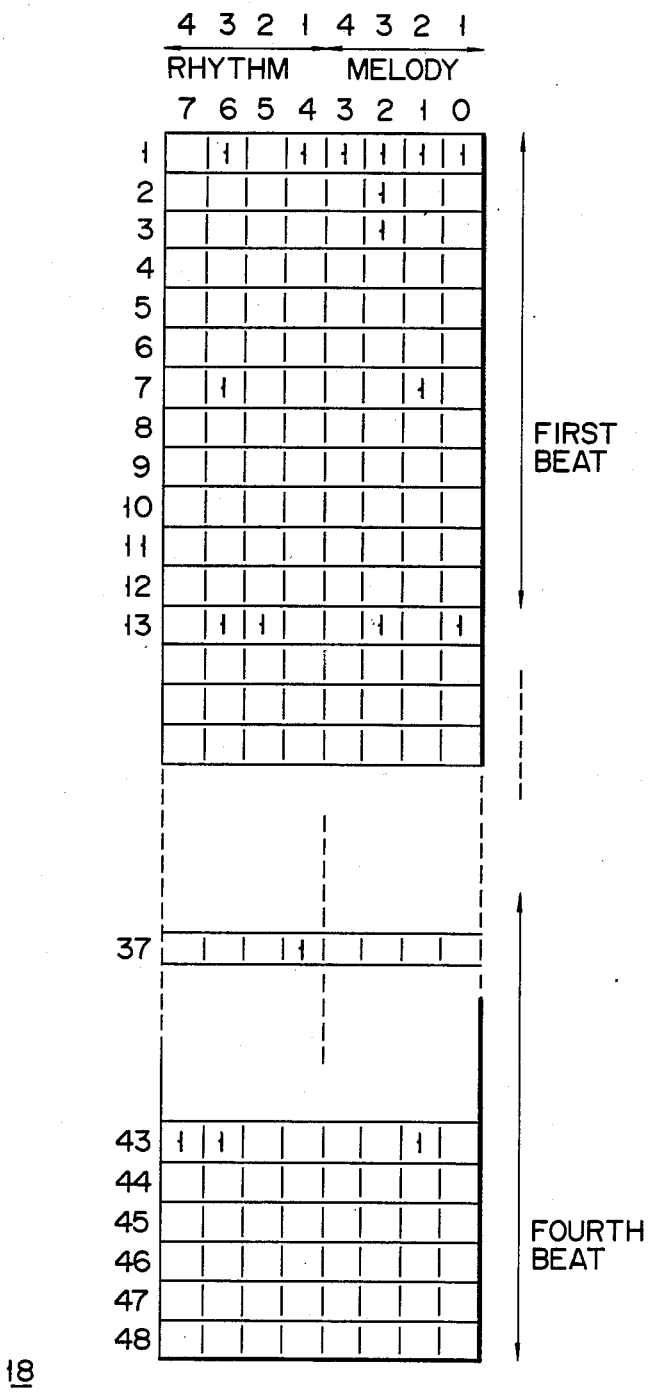
FIGS. 4 through 7 show trigger map 18, pattern control area 19, melody tone pitch area 20 and rhythm tone color area 21 of pattern memory 10, respectively.

Pattern memory 10, as shown in FIG. 3, has 20 pattern areas corresponding to 20 types of pattern data, respectively. These pattern areas are accessed by rhythm select switches 28. Each pattern area has trigger map 18, pattern control area 19, melody tone pitch area 20 and rhythm tone color area 21. Trigger map 18, as shown in FIG. 4, has a memory capacity of 48 addresses corresponding to a memory capacity for four beats in one bar. Each address has a memory capacity consisting of 8 bits corresponding to the respective eight channels of rhythm and melody. In the trigger map, rhythm and melody sounding timings are stored. For the rhythm pattern, data "1" is set to a corresponding bit of bits 4 to 7 in an address corresponding to the sounding timing. For the melody pattern, "1" is set to in a corresponding bit of bits 0 to 3 in an address corresponding to the sounding timing or "off" timing.

Figure 5:
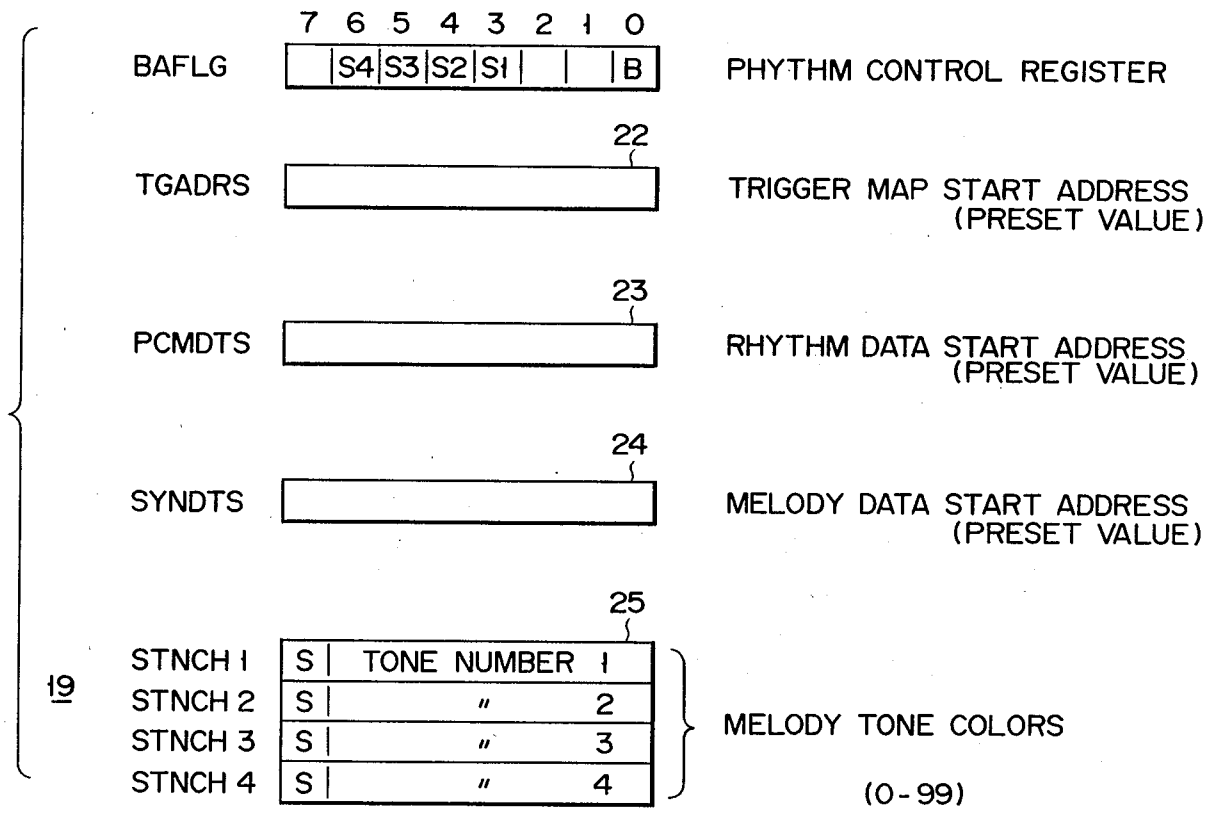

Pattern control area 19, as shown in FIG. 5, has trigger map start address register 22, rhythm data start address register 23, melody data start address register 24 and melody tone color registers 25. Start addresses of trigger map 18, melody tone pitch area 21 and rhythm tone color area 21 are preset in trigger map start address register 22, rhythm data start address register 23 and melody data start address register 24, respectively. Tone color data designated by tone color select keys 6, allotted to four types of melodies 1 to 4, are stored in melody tone color registers 25.

Figure 6:
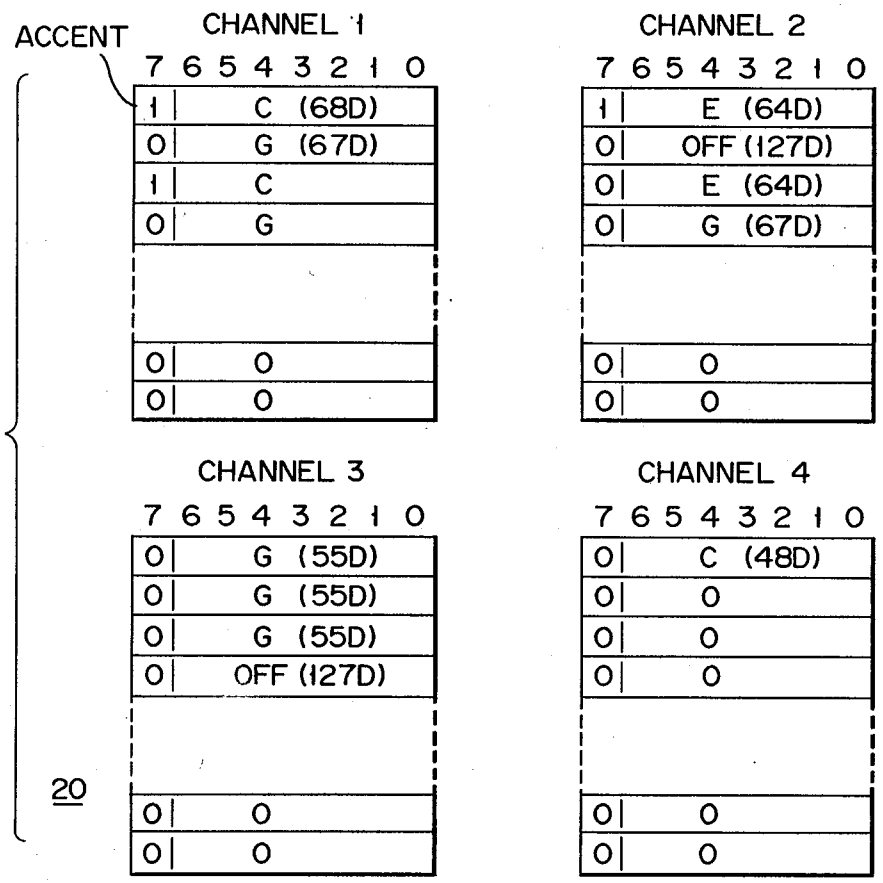

In the melody tone pitch area 20, pitch data (7-bit data) of four melody patterns are stored in the order of sounding, as shown in FIG. 6, and an accent data indicative of strong sounding is stored in the MSB (most significant bit).

Figures 7, 8:
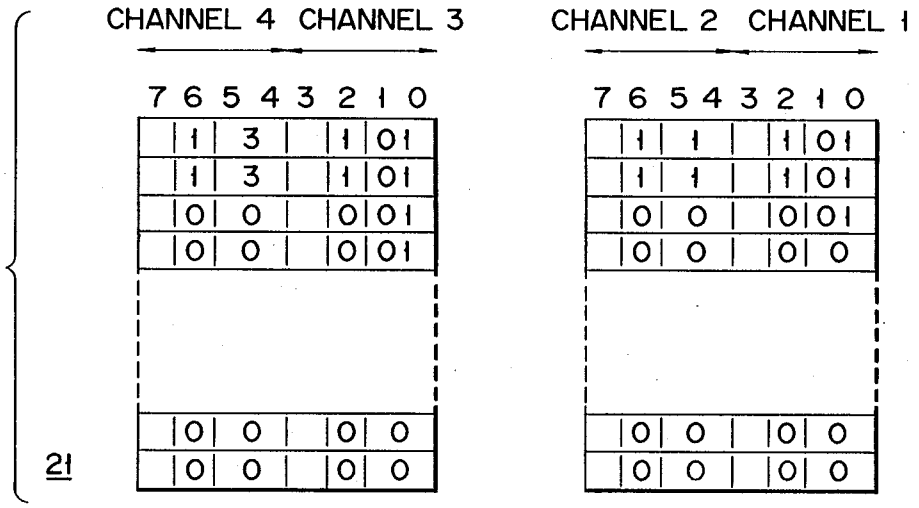
FIG. 8 is a diagram for explaining the kinds of rhythms and codes thereof.

Tone color data (LSB 2 bits) of four rhythm patterns as shown in FIG. 7 are stored in rhythm tone color area 21, and also accent data is stored in the third bit in the melody tone color area 20. The tone color data of the rhythm pattern, as shown in FIG. 8, can specify three tone colors for each channel, and the tone color is specified by a code of 01, 10 and 11.

Figure 9A:
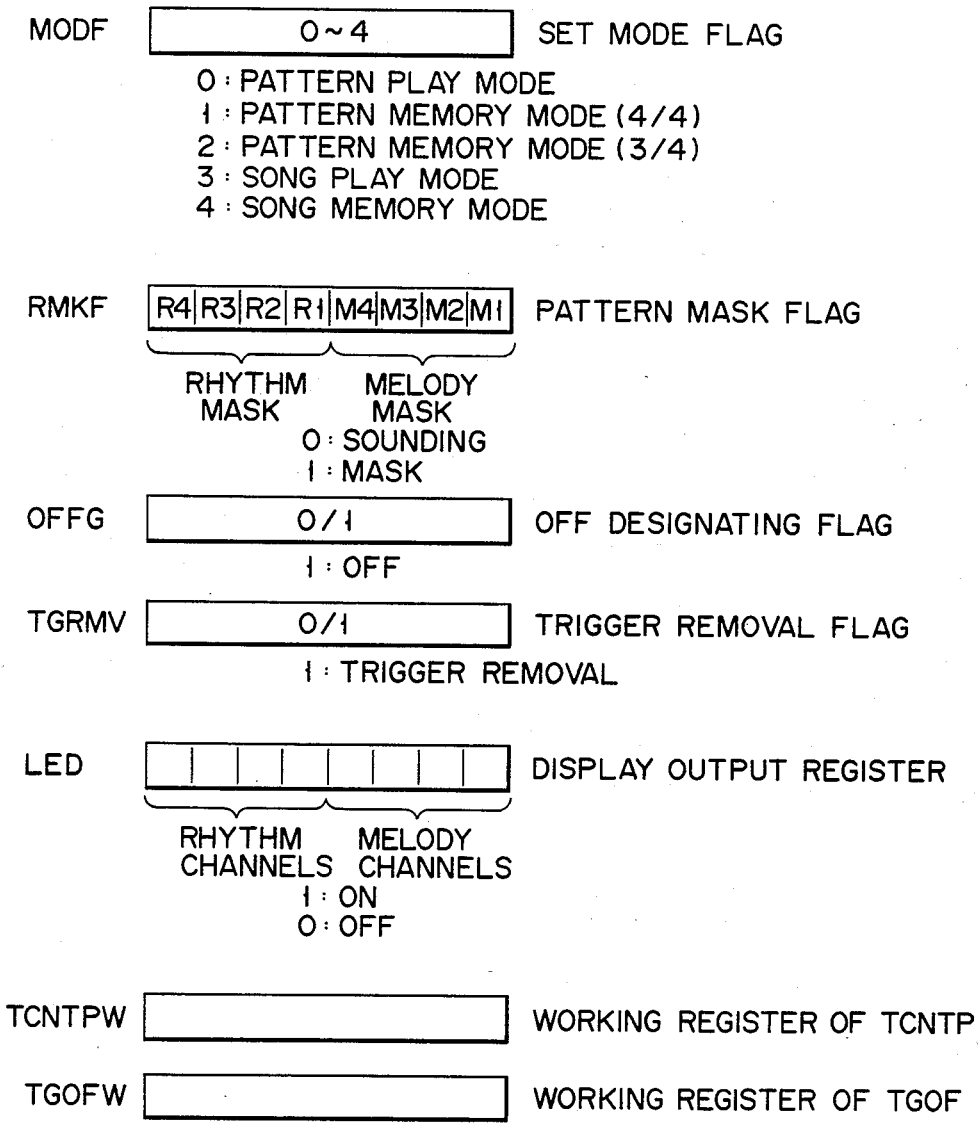
FIGS. 9A through 9C show, in combination, various registers of working memory 17.
Figure 9B:
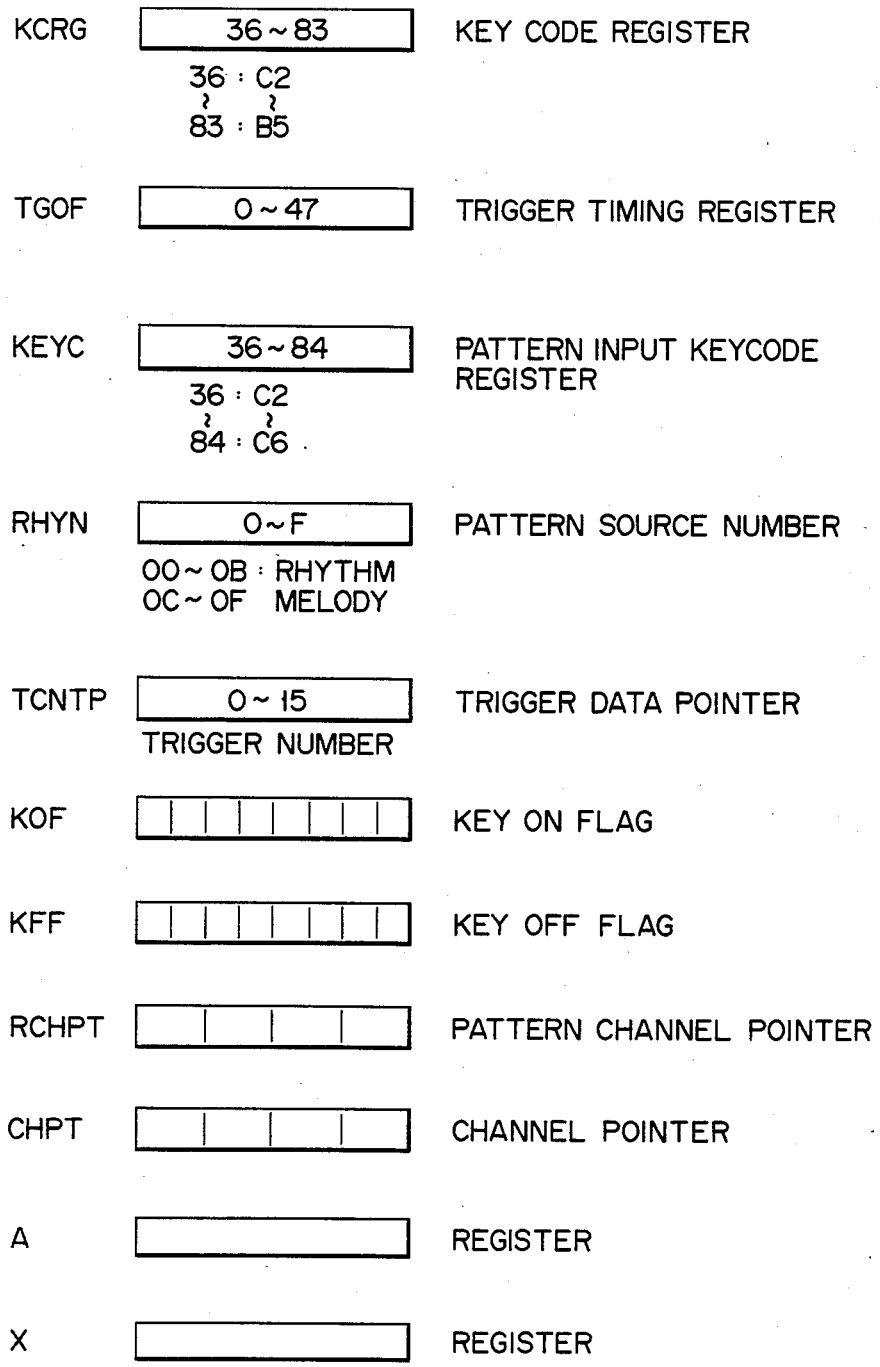
Figure 9C:
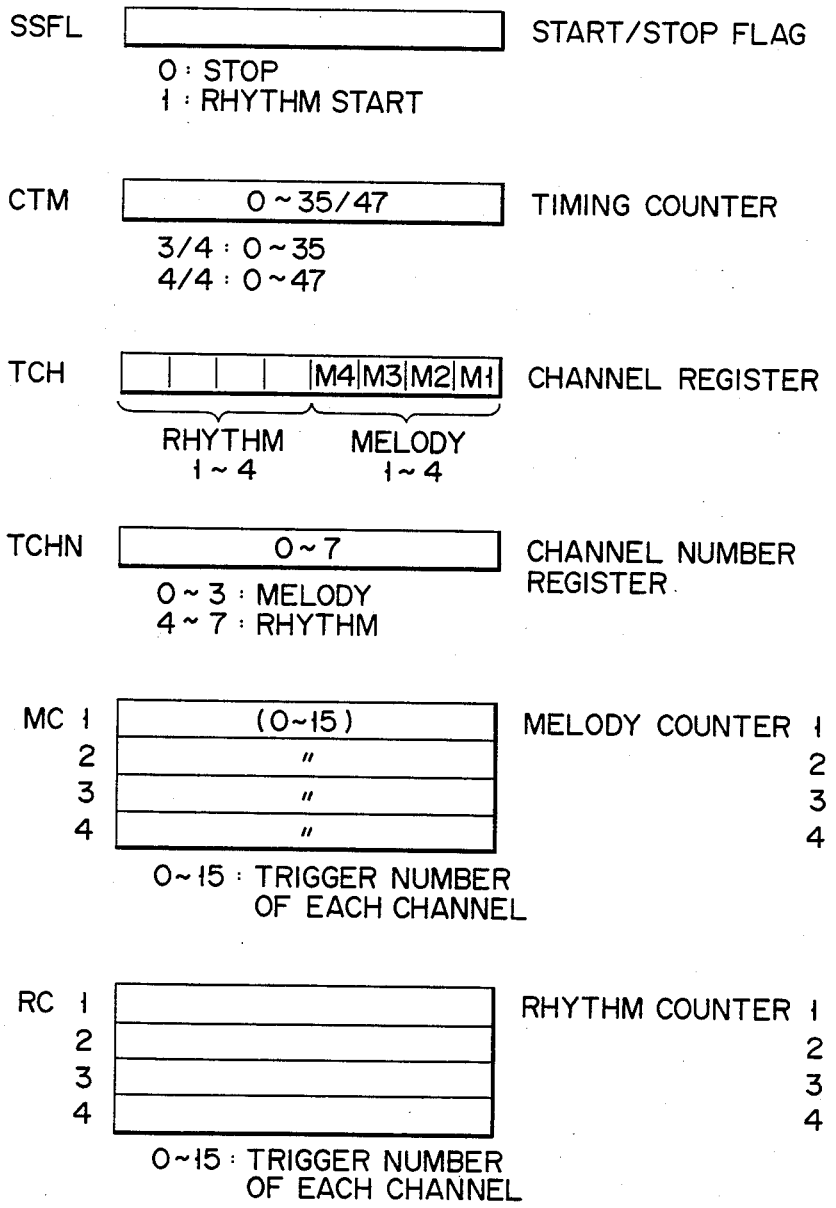

The working memory 17, as shown in FIGS. 9A to 9C, consists of various registers used for writing and reading rhythm and melody patterns. The functions of these registers will now be described.

In mode-setting flag MODF, a value corresponding to the state of memory/play switching lever 1 is set. Data "0" is set when the pattern play mode is set. "1" is set when the 4/4 time memory mode is set. "2" is set when the $\frac{3}{4}$ time memory mode is set. "3" is set when the song play mode is set. "4" is set when the song memory mode is set.

In pattern mask flag RMKF, data is set according to the state of mask keys 26 and 27, i.e., "0" is set for sounding and "1" for masking. Rhythm channel 1 corresponds to R1, rhythm channel 2 to R2, rhythm channel 3 to R3, rhythm channel 4 to R4, melody channel 1 to M1, melody channel 2 to M2, melody channel 3 to M3, and melody channel 4 to M4.

In "off"-designating flag OFFG, "1" is set when "off" (rest) is designated.

In trigger removal flag TGRMV, "1" is set when removing trigger data of the trigger map.

In display output register LED, "1" is set when rhythm and melody sounding timings are reached.

Working register TCNTPW of TCNTP is incremented every time trigger data is obtained in the melody pattern memory mode, that is, the number of triggers is stored.

In tone pitch register KCRG, a key code of an operated key is set. The key code is the MIDI (Musical Instrument Digital Interface) code. C2 to B5 correspond to data "36" to "83" in the MIDI code.

In trigger timing register TGOF, a value corresponding to the position of an operated key (corresponding to a sounding timing in one bar) is set. "0" is set for C2 and "47" is set for B5.

Input key code register KEYC is a register in which data is first set when a key is operated. The data is based on the MIDI code.

In pattern source number register RHYN, a value corresponding to the tone color of rhythm and melody is set. The bass drum shown at the left end of rhythm-/melody switching lever 2 corresponds to "00", the snare drum to "01", melody 3 to "OE", and melody 4 to "OF".

In trigger data pointer TCNTP, trigger number data is stored. The data is transferred from working register TCNTPW.

In register X, the sum of trigger map start address TGADRS and a count of timing counter CTM is stored.

In register A, trigger data of the trigger map addressed by register X is set.

In start/stop flag SSFL, data is set by the operation of start/stop key 4. The set data is "1" while a rhythm is in progress and "0", otherwise.

Timing counter CTM counts from 0 to 35 for one bar in the $\frac{3}{4}$ time mode, and counts from 0 to 47 in the 4/4 time mode.

Channel register TCH consists of 8 bits, and "1" is set to a bit corresponding to a designated channel. The last four bits correspond to the 1st to 4th melody channels and first four bits to 1st to 4th rhythm channels.

In channel number register TCHN, the channel number of a channel presently being designated is set. Data "0" to "3" correspond to the 1st to 4th channels, and data "4" to "7" correspond to the 1st to 4th rhythm channels.

Four melody counters MC are each provided for a respective melody channel. Each counter is incremented every time trigger data is read out for a corresponding channel.

Four rhythm counters RC are each provided for a respective rhythm channel. Each counter is incremented every time trigger data is read out for a corresponding channel.

(Operation of Embodiment)

Writing Rhythm Pattern

Figure 10:
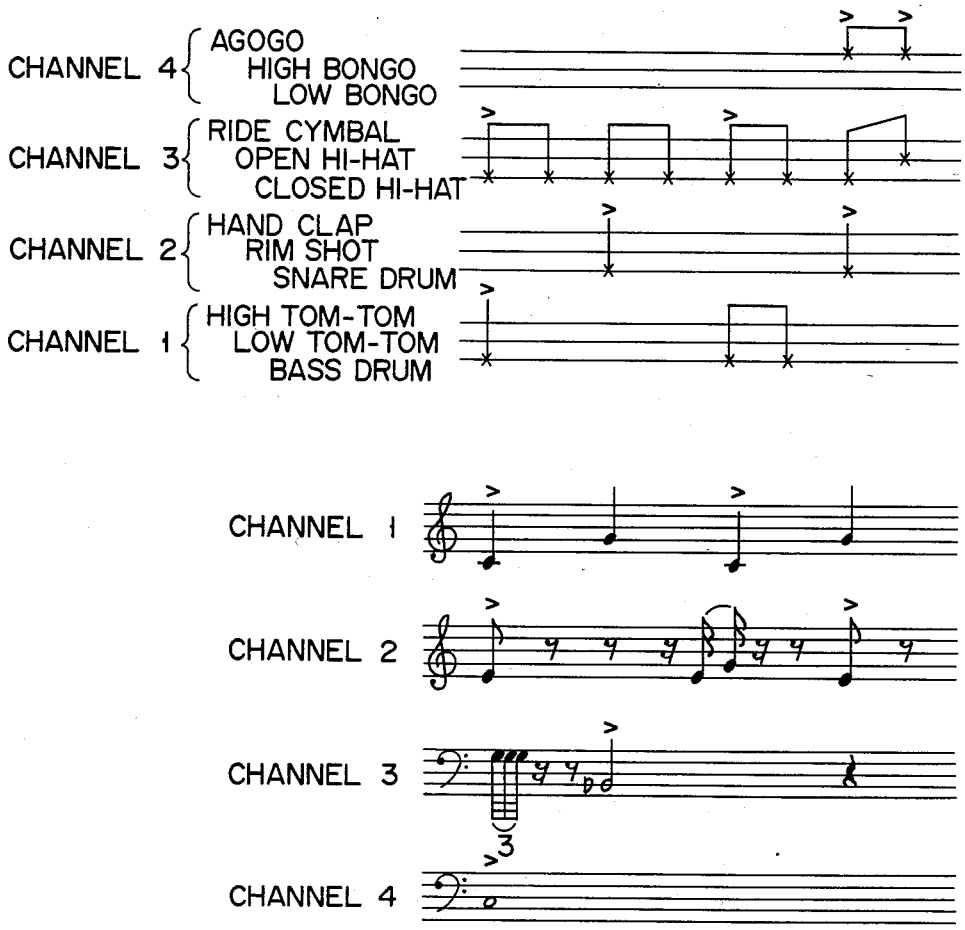
FIG. 10 shows, by way of example, rhythm and melody patterns in a rock music composition.

In order to automatically perform the rhythm and melody of a rock music composition as shown in FIG. 10, it is assumed that the rhythm pattern for agogo is first set in channel 4.

Figure 11A:
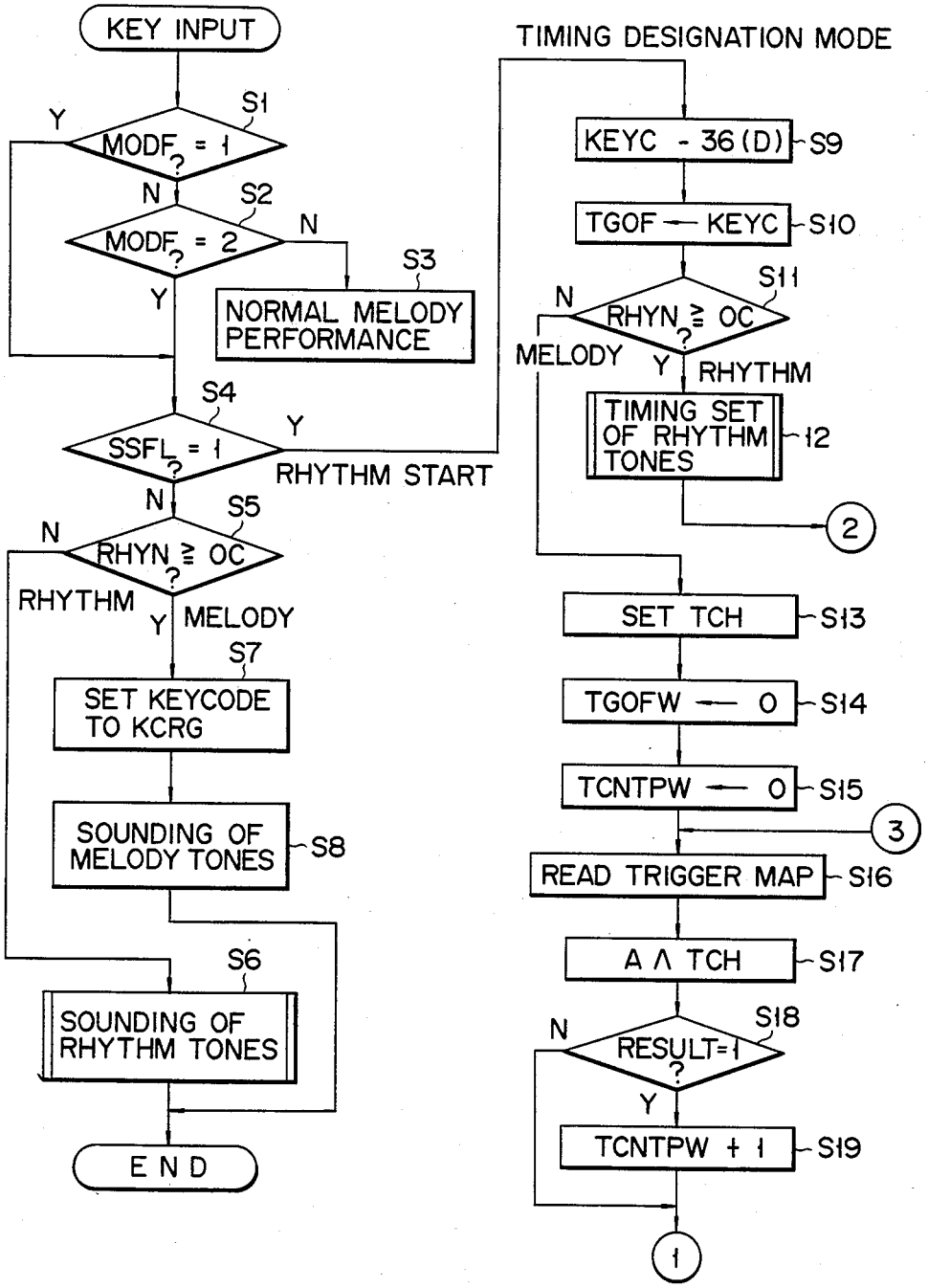
FIGS. 11A and 11B show, in combination, flow charts for explaining a procedure of writing pattern data.
Figure 11B:
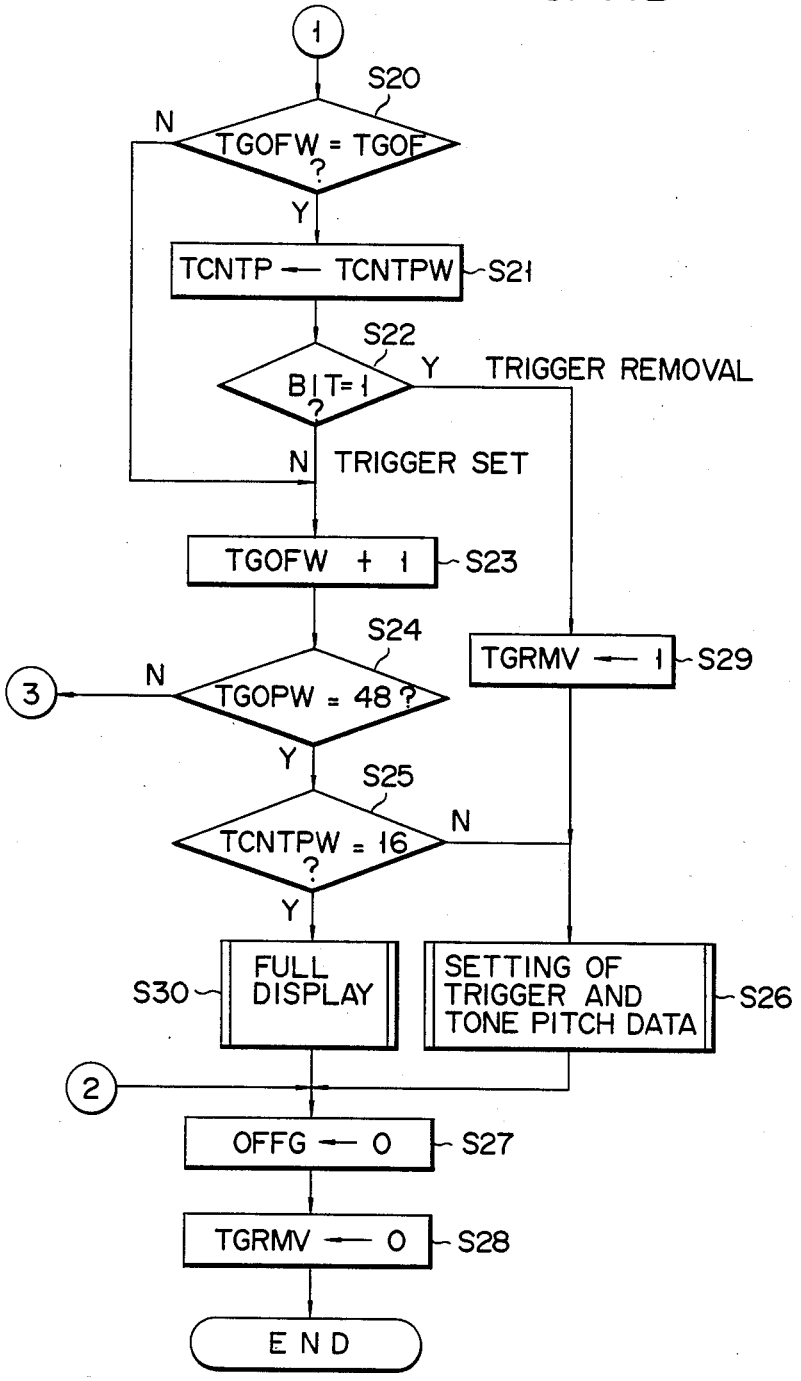

In this case, memory/play switching lever 1 is set to the 4/4 time pattern memory mode, rhythm/melody switching lever 2 is set to the agogo mode, and start/-stop key 4 is turned on. Subsequently, the 37th key on keyboard 5 corresponding to the sounding timing of the 1st tone of the agogo rhythm pattern shown in FIG. 10 and the 49th key for accent are operated. As a result, "1" is set in mode-setting flag register MODF and start/stop flag register SSFL of working memory 17. CPU 9 detects this operation in steps S1 and S4, shown in FIGS. 11A and 11B. Also, since a key code value of the MIDI code of "72" corresponding to the 37th key is set in input key code register KEYC of working memory 17, CPU 9 subtracts the value of "36" from the key code value of the MIDI code and sets the difference of "36" (key number) in trigger timing register TGOF (steps S9 and S10).

In pattern source number register RHYN of working memory 17, a code "0B", corresponding to the agogo, is set. "00" to "0B" are allotted for the rhythm tone colors (instruments), and "OC" to "OF" for the melody types (1~4). The bass drum at the left end of the rhythm/melody switching section corresponds to "00", and melody type 4 at the right end to "0F". Since "0B" is less than "0C", CPU 9 detects the rhythm pattern memory mode (step S11), and sets data "1" in the 37th address of the 4th channel area of rhythm of trigger map 18 according to the value of trigger timing register TGO and agogo tone color number "3(11)" of FIG. 8 and accent data "1" in the first address of the 4th channel area of rhythm tone color area 21, as shown in FIG. 7 (step S12). Then, CPU 9 clears "off" designation flag OFFG and trigger removal flag TGRMV (steps S27 and S28).

After operation of the 37th key, the 43rd key (corresponding to the timing of the sounding of the second tone) and the 49th key (for accent) are operated. As a result, the rhythm pattern setting process of steps S1, S4, S9 to S12, S27 and S28 is repeated. Thus, "1" is set to the 43rd address of the 4th channel area of rhythm of trigger map 18. Tone color number "3 (11)" of agogo and accent data "1" are set to the 2nd address of the 4th channel area of rhythm tone color area 21, as shown in FIG. 7. As for the closed high-hat, snare drum and bass drum shown in FIG. 10, rhythm pattern data may be set in trigger map 18 and rhythm tone color area 21 in the similar manner.

Writing Melody Pattern

In this case, the melody patterns shown in FIG. 10 are set from the 1st channel.

To this end, without operating memory/play switching lever 1, rhythm/melody switching lever 2 is positioned to the melody 1 mode, and the tone color of melody 1 is designated by melody tone color select keys 6. Subsequently, the pitch is designated by depressing the key of C4 for the first tone of the 1st channel shown in FIG. 10. "1" has been set in mode flag register MODF of working memory 17, and "0" is in start/stop flag register SSFL. In pattern source number register RHYN, a value "0C", corresponding to melody 1, is set. Since this value is equal to "0C", CPU 9 detects the melody pattern memory mode (step S5) and sets a key code of C4 (60) in pitch register KCRG of working memory 17 to sound the melody tone of pitch C4 (steps S7 and S8).

Then, after designating the pitch C4, start/stop key 4 is turned on, and then the 1st key of the keyboard 5 corresponding to the timing of sounding of the first tone of the 1st channel, shown in FIG. 10, and the 49th key, for accent, are operated. After steps S1, S4 and S9, CPU 9 sets "0" in trigger timing register TGOF in step S10. CPU 9 then sets "1" to a bit of channel register TCH, corresponding to the channel number of melody 1 in step S10, so that the content of the channel register becomes "00000001". Then, the CPU clears working registers TGOFW and TCNTPW (steps S14 and S15) and reads out 8-bit trigger data from the 1st address of trigger map 18 designated by working register TGOFW. The CPU receives 8-bit trigger data and "00000001" in channel register TCH, ANDs corresponding bits of both data and checks as to whether either one of ANDs (logical products) is "1" (steps S16, S17 and S18). In this case, in channel register TCH, only the bit of melody 1 is "1", so that a check is done as to whether trigger data has been set in the channel area of melody 1.

In the channel area of melody 1 of the 1st address of trigger map 18, no trigger data is set at this time, so that the logical product (AND) is not "1". Therefore, CPU 9 effects a check as to whether the value "0" in working register TGOFW and the data in trigger timing register TGOF coincide with each other. At present, the data in trigger timing register TGOF is "0". Therefore, CPU 9 detects that a trigger-data retrieval up to the sounding timing designated by the present key depression has been completed. The routine then goes to step S21, in which data "0" in working register TCNTPW is transferred to pitch output pointer register TCNTP to memorize the number of trigger data obtained so far.

Since the channel area of melody 1 in the 1st address of trigger map 18 represents "0", CPU 9 judges that trigger data is to be set (step S22). Then, CPU 9 increments working register TGOFW by 1 to "1" (step 23), and continues the trigger retrieval of steps S16 to S23 until the data in working register TGOFW, which is progressively incremented in step S23, becomes "48" (step S24). The data "48" in working register TGOFW means that trigger retrieval up to the 48th address of the channel area of melody 1 of trigger map 18 has been completed. At this time, since working register TCNTPW is incremented every time trigger data is detected in steps S18 and S19, a number of trigger data corresponding to one bar of the melody are stored therein.

Then, CPU 9 effects a check as to whether the data in working register TCNTPW is above "16" (step S25). Since no trigger data of melody 1 has been set and the data in working register TCNTPW is "0", the routine goes to step S26, in which CPU 9 sets trigger data of the first tone of melody 1 and tone pitch data. Then steps S27 and S28 of initialization are executed. The reason why, in step S25, a check is done as to whether the number of trigger data is above "16" is that trigger data above 16 exceeds the memory capacity of melody pitch area 20. When the trigger data number exceeds 16, CPU 9 displays on numerical display section 8 that the allowable data capacity is exceeded (step S30). If it is detected in step S22 that trigger data "1" has already been set in the address of trigger map 18 corresponding to the timing of sounding designated by the depressed key, CPU 9 determines that the trigger is to be removed. Thus, it sets "1" in trigger removal flag register TGRMV (step S29), and removes the trigger data and corresponding pitch data (step S26). This is done because a second depression of the key corresponding to the timing of the trigger data, which had been set by the first depression, removes the previously set trigger data. That is, the trigger data can be cancelled by depressing the same key twice.

For the second and subsequent tones, the start/stop key is depressed, and the pitches are designated. The trigger data and pitch data are set in the similar way. Further, by switching rhythm/melody switching lever 2 and performing the above operations, the melody patterns can be set in the similar way for the melodies of the 2nd to 4th channels shown in FIG. 10.

In this way, the setting of a rhythm pattern is effected in steps S1, S4, S9 to S12, S27 and S28, and the retrieval of melody trigger data and the setting of melody pattern are effected in steps S1, S4, S9 to S11, S13 to S30.

As will be evident from the foregoing description, a melody pattern can be stored as part of the rhythm pattern constituent tones, to be perfectly integral with the rhythm. Namely, the melody pattern can be stored in a timed relation to the rhythm pattern according to the progress of a musical piece.

With rhythm/melody switching lever 2 being set to a rhythm mode and start/stop key 4 being off, CPU 9 sounds rhythm tones corresponding a rhythm source number (step S6) because mode setting flag MODF is "1", start/stop flag register is "0" (steps S1, S4) and pattern source number register RHYN is below "0C". When memory/play switching lever 1 is switched to the pattern play mode, an ordinary melody performance may be carried out by operating keyboard 5 (steps S1~S3).

Setting Trigger and Tone Pitch Data

Figure 12A:
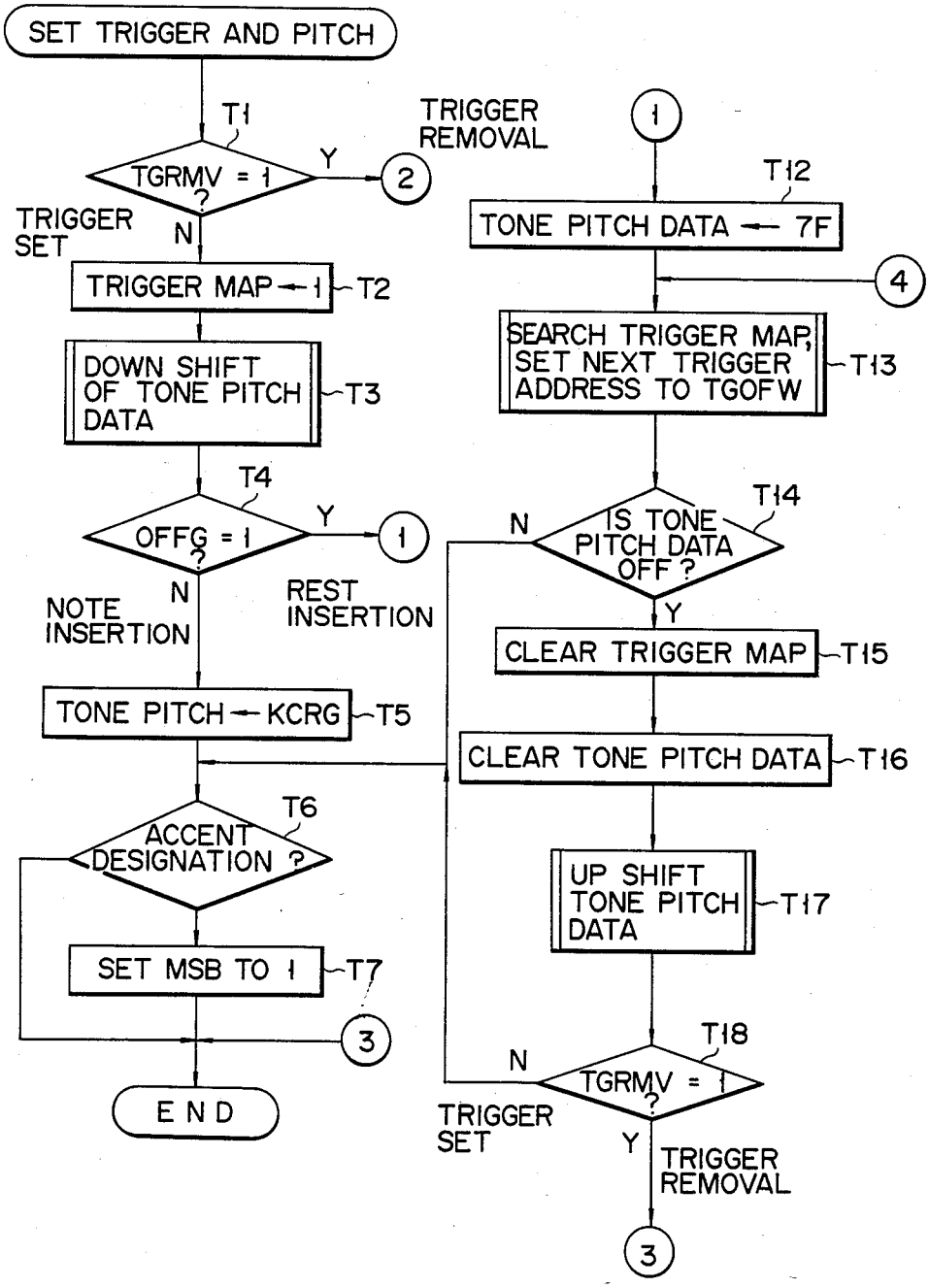
FIGS. 12A and 12B show, in combination, flow charts for explaining a procedure of setting trigger and tone pitch data.
Figure 12B:
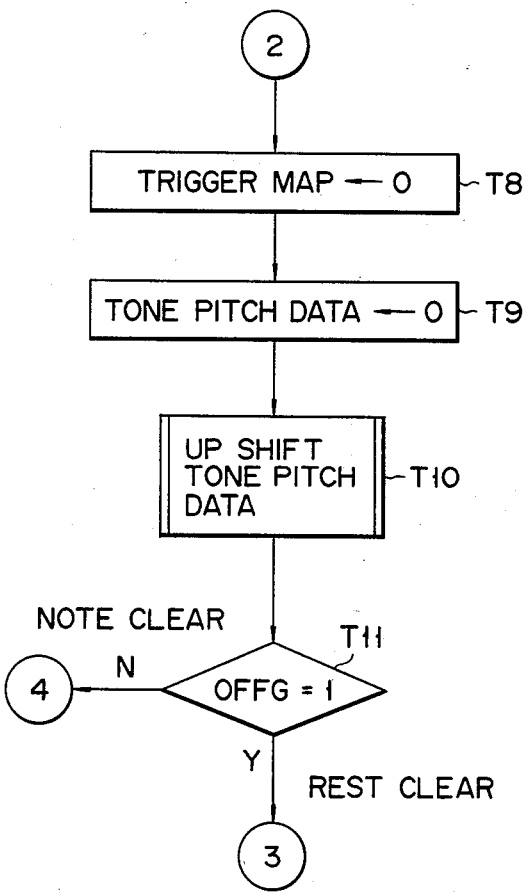

The setting of trigger and pitch data in step S26 is done in a manner shown in FIGS. 12A and 12B. A description is made, by way of example, of setting the first tone of melody of the 1st channel shown in FIG. 10.

Since trigger removal flag TGRMY is not set in steps S22 to S25 (step T1), CPU 9 sets trigger data "1" in the channel number area of melody 1 in the 1st address of trigger map 18, corresponding to the designated sounding timing in trigger timing register TGOF, (step T2). Pitch data stored subsequent to the first address of melody pitch area 20, after the number of trigger data stored in pitch data pointer register TCNTP, is progressively down-shifted (step T3). As a result, the address of melody pitch area 20, in which next pitch data is to be set, is cleared. It is to be noted that the down-shifting of pitch data is not effected in a case where trigger data is input according to the score of a musical piece. Down-shifting of pitch data is effective when it is desired to insert new pitch data between pitch data that has already been set.

Then, CPU 9 effects a check as to whether "off" designating flag OFFG is "1" (step T4). Flag OFFG of "1" means that rest data is to be input. Flag OFFG remains "0" in step S27, so that the routine goes to step T5. In step T5, pitch data of the first tone of C4 of melody 1, set in pitch register KCRG in step S7, is set in the cleared address of melody pitch area 20. Since accent designation is done for the first tone, "1" is set to the MSB of this address (steps T6 and T7).

If it is detected in step T1 that trigger removal flag TGRMV is set, CPU 9 clears trigger data "1" in the address of trigger map 18 corresponding to the designated sounding timing (step T8). CPU 9 also clears the corresponding pitch data in melody pitch area 20 (step T9) and up-shifts subsequent pitch data (step T10). CPU 9, as in step T4, detects that "off" designating flag OFFG is "0" (step T11), and sets in working register TGOFW an address in which trigger data "1" is first set, subsequent to the designated sounding timing of trigger map 18 (step T13). If pitch data of melody pitch area 20, designated by register TGOFW, is "off" data (rest data 7F) (step T14), the CPU clears the trigger data "1" (step T15), and corresponding pitch data of melody pitch area 20 (step T16). CPU 9 up-shifts subsequent pitch data, thus removing "off" pitch data corresponding to the removed "on" pitch data. When it is detected that the trigger removal flag is "1" (step T18), the routine is terminated. The above steps are performed for removing the second and following rest data when rests continue and removing rest data which follows removed note data.

The "off"-designating flag OFFG is set to "1" when rest data is set by an operation of the cancel key of melody tone color select keys 6, together with the operation of keyboard 5. If it is detected in step T4 that "off"-designating flag OFFG is "1", CPU 9 sets data 7F (01111111=127D) representing a rest in the cleared address of melody pitch area 20 (step T12) and executes steps T13 to T18 of clearing next rest data and steps T6 and T7 of setting accent data. If the next data is not rest data but note data, steps T14 to T18 of clearing rest data are not executed.

In this way, melody pattern data is set in steps T1 to T5, melody pattern data is removed in steps T8 to T11, the next rest is removed when note data is removed and new rest data is inserted in steps T12 to T18, and accent data is set in steps T6 and T7.

Reading Pattern Data

The reading of the rhythm and melody patterns that have been written in the above way will now be described with reference to the flow chart of FIGS. 13A and 13B. This routine is executed every time an interrupt signal is obtained. CPU 9 issues an interrupt signal to working memory 17 in response to timer 29. In the 4/4 time mode, the interrupt signal is generated 48 times during one bar (measure).

Every time a bar start timing is reached, or the timing counter CTM, counting the interrupt signal, becomes "0", CPU 9 turns off all LEDs 7 (steps R1 and R2), sets data of trigger map start address TGADRS plus timing count of CTM in the X register (step R3), and sets trigger data, stored in the address of trigger map 18 addressed by X register, into A register (step R4). Then, CPU 9 ANDs corresponding bits of data in the A register and channel register TCH (step R5) and checks as to whether either one of the logical products of the corresponding bits is "1" (step R6). Since the initial data in channel register TCH is "01 (00000001)", a check as to whether trigger data has been set in the channel area of melody 1 is done in step R6. Since trigger data "1" has been set in the first address of the channel area for melody 1, in trigger map 18 for melody 1, the corresponding logical product is "1".

Since the data "01" in channel register TCH is less than "10H" (00010000), CPU 9 judges that the melody tone sounding mode prevails (step R7) and adds the value of melody data counter MC (1) to the data of melody start address SYND (step R20). Melody counters MC1~MC4 are each incremented every time trigger data "1" is read out for a corresponding channel. CPU 9 reads out note data C4 (60) in the address of melody pitch area 20, addressed by the sum of the melody start address SYNDTS and the count of melody counter MC1 (step R21), and checks as to whether the pitch data is rest data 7F. Since the pitch data of C4 is not a rest, CPU 9 sets key "on" flag KOF (step R23), turns on LED 7 for M1 among LEDs 7 corresponding to melody 1 (step R24), and effects channel assignment to the tone of C4 (step R27).

In this way, the melody tones are sounded and the LED visually indicates that the musical tones of melody 1 are being sounded. The number of polyphonic tones being sounded may be displayed on numerical display section 8.

Then, CPU 9 increments melody counter MC (1) by 1 (step R28) and up-shifts "1" of LSB of channel register TCH by one bit to obtain "00000010". This means a channel mode for melody 2 (step R18). The CPU then increments channel number register TCHN by 1 to designate the channel for melody 2 (step R19). The steps R5 to R7, R20 to R28, R18 and R19 for sounding melody tones and lighting LED7 are also executed for melody 2. The same processings are sequentially executed for melodies 3 and 4.

When data "7F" of a rest is read out in steps R21 and R22, CPU 9 sets key "off" flag KFF (step R25) and turns off LED 7 that has been "on" (step R26).

When the data of channel register TCH and channel number register TCHN become "10 (00010000)" and "4", respectively, CPU 9 determines in step R7 that a rhythm tone sounding mode is set up, and sums data of rhythm data counter RC (1) and rhythm start address PCMDTS (step R8). Rhythm data counters RC1~RC4 are each incremented every time trigger data "1" is read out for a corresponding channel. Since the channel being processed is the 1st channel, i.e., an odd number channel, CPU 9 reads out rhythm tone color data "1" of the bass drum in bits 0 to 3 of rhythm tone color area 21 addressed by the sum of the rhythm start address PCMDTS and the count of rhythm data counter RC1 (steps R9, R10 and R12).

Subsequently, CPU 9 ANDs corresponding bits of data of pattern sounding mask flag RMKF and data "1OH" (=00010000) of channel register TCH (step R13) and checks whether a logical product (AND) is "0" (step R14). In pattern sounding mask flag RMKF, data "1" is set to a bit corresponding to an "on" key among collective and individual mask keys 26 and 27. If "1" is not set to any bit, the logical products are all 0. Thus, rhythm tones are sounded according to bass drum rhythm tone color data (step R15). If "1" is set to a corresponding bit of pattern sounding mask flag RMKF, step R15 is not executed, and the sounding is inhibited.

In the above way, it is possible to prohibit rhythm tones in a selected rhythm channel from being sounded.

CPU 9 increments rhythm counter RC (1) by 1 (step R16), and judges that the data in channel register TCH is "10" and not "8OH" yet (step R17) to repeats steps R18, R19 and R5 to R16 for sounding rhythm tones. In this case, for the 2nd and 4th channels, i.e., even number channels, rhythm tone color data is read out from bits 4 to 7 of rhythm tone color area 21 subsequent to step 9 (step R11).

When the sounding process for all the channels is completed, data in channel register TCH becomes "8OH", so that CPU 8 judges this in step R17, and increments timing counter CTM by 1 (step R29). The routine of FIGS. 13A and 13B is repeated until data in timing counter CTM becomes "48". When the play for one bar terminates, the data in timing counter CTM becomes "48", CPU 9 judges that the memory mode does not prevail (step R31), and returns each of the addresses of trigger map, melody data and rhythm data of working memory 17 to the start address (step R32). Then, CPU 9 clears rhythm data counter RC (n), melody counter MC (n), timing counter CTM and channel number counter TCHN, and sets channel register TCH to "01H" (steps R33 to R37). In this case, if the operation is in a memory mode, e.g., pattern or song memory mode, step R33 is executed immediately after step R31, and re-setting of each start address is not done.

After LED 7 has been turned off in steps R1 and R2, steps R8 to R16 for rhythm tone sounding and steps R20 to R28 of melody tone sounding are executed for each channel. Steps R29 to R38 for initialization are executed every time the play for one bar has been completed. In this case, steps R14 and R15 are executed for sound masking, and steps R23 to R26 for lighting LEDs 7.

Figure 13A:
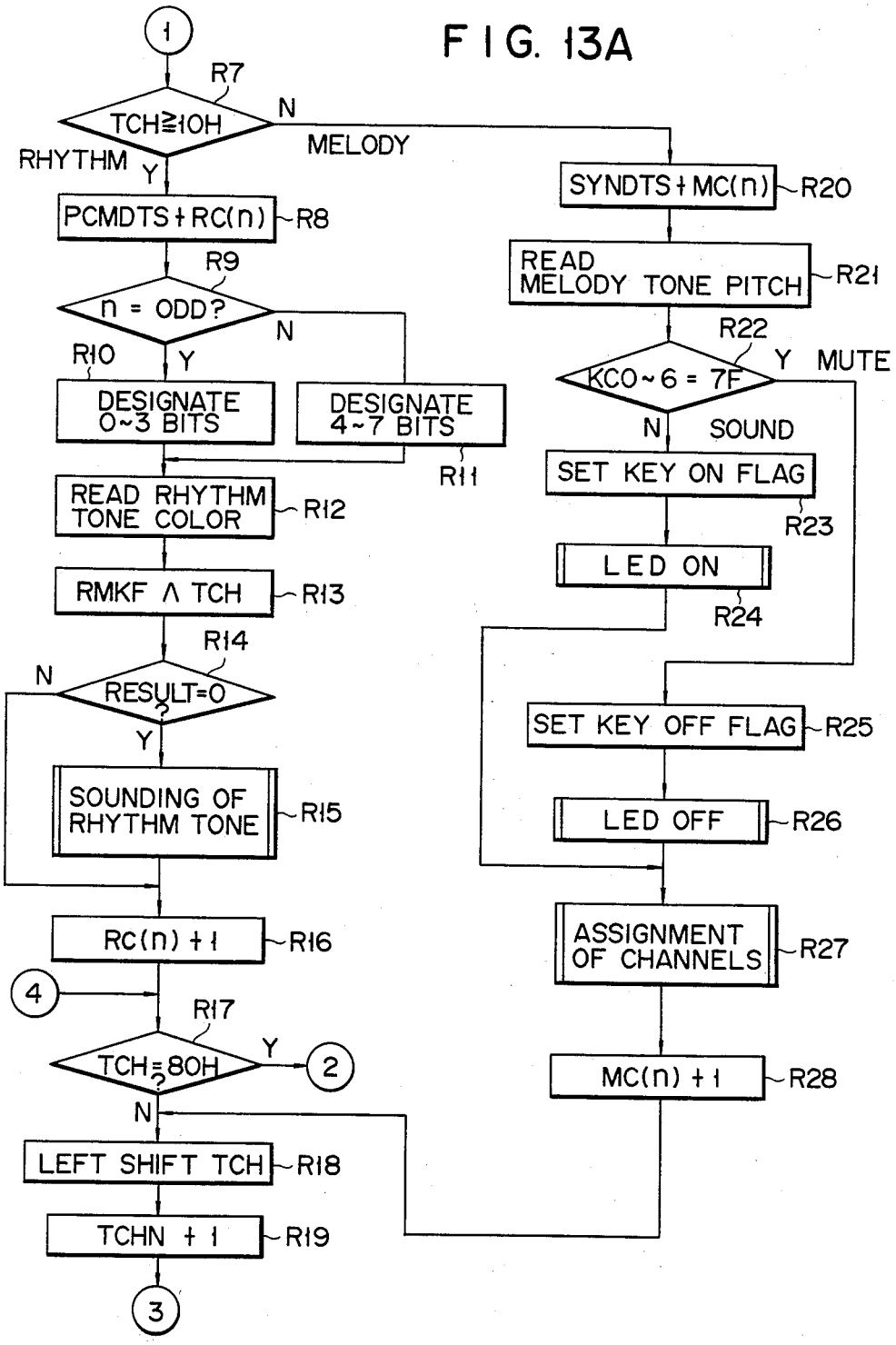
FIGS. 13A and 13B show, in combination, flow charts for explaining a procedure of reading out pattern data.
Figure 13B:
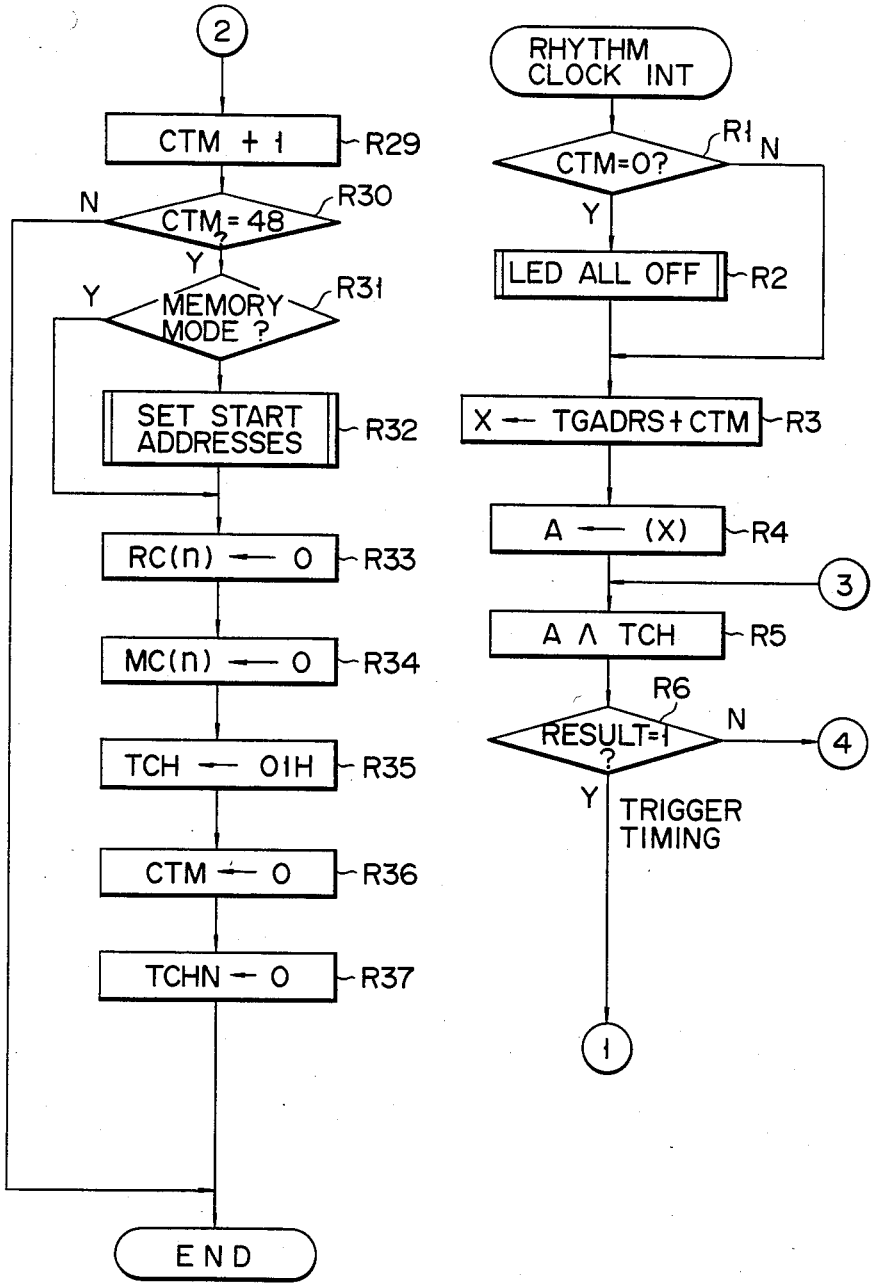

For the convenience of description, several steps are excluded in the flow chart in FIG. 13A. In practice, there are the same steps as steps R22 to R26 between steps R15 and R16, so that LEDs 7 are lit for rhythm tones as well. Also, there are the same steps as steps R14 and R15 between steps R26 and R27, for sounding and masking melody tones.

Assigning Channels

Figure 14:
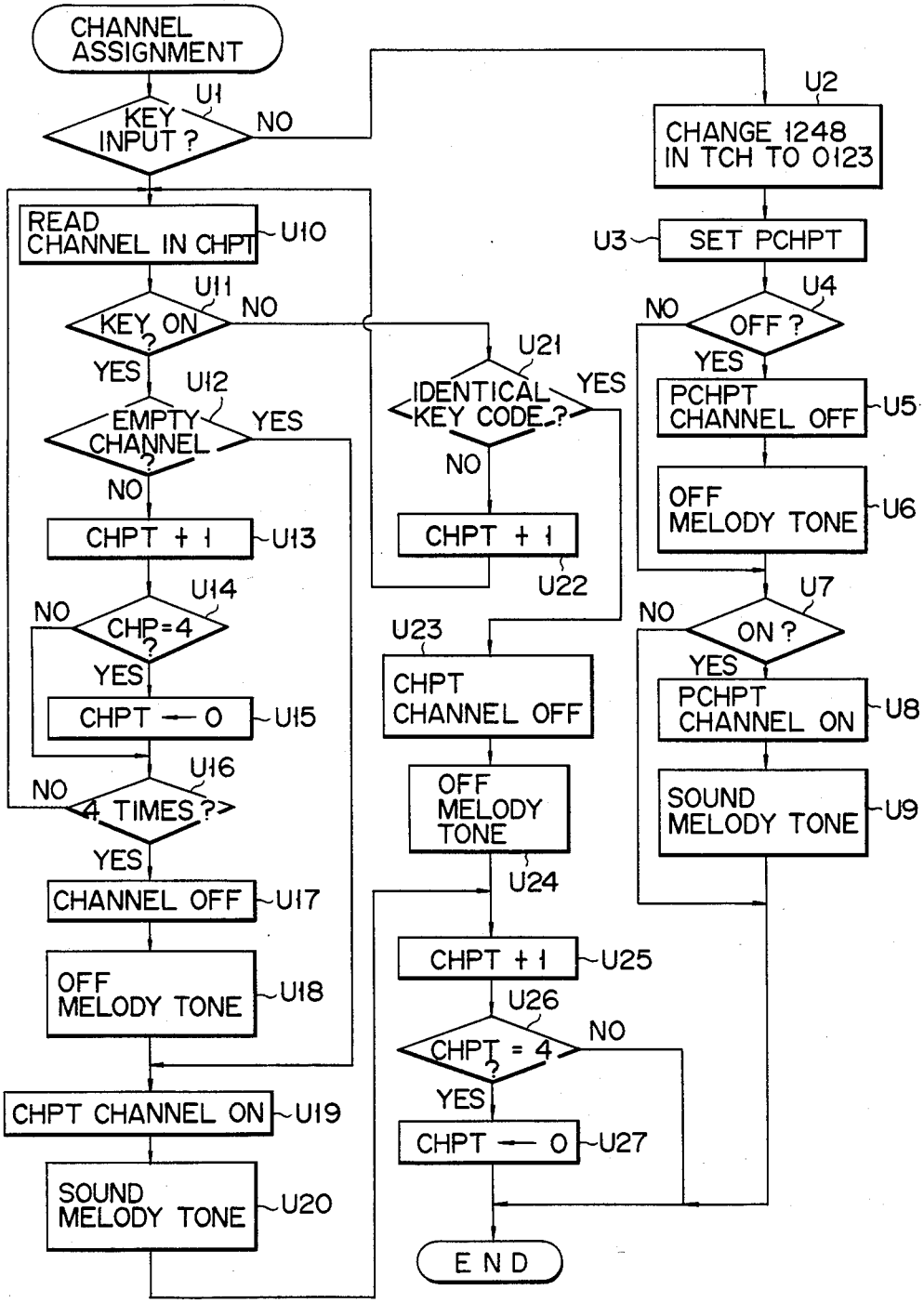
FIG. 14 is a flow chart for explaining a procedure of channel assignment processing.

The assignment of channels in step R27 is effected in the routine as shown in the flow chart of FIG. 14.

More specifically, when CPU 9 detects not melody tone sounding by keyboard 5 but melody tone sounding by melody pattern play (step U1), it converts data of "1 (0001)", "2 (0010)", "4 (0100)" and "8 (1000)" of lower 4 bits in channel register TCH in working memory 17 into "0 (0000)", "1 (0001)", "2 (0010)" and "3 (0011)" and sets these in pattern channel pointer RCHPT (steps U2 and U3). If pitch data read out from melody pitch area 20 is key "on" data (steps U4 and U7), melody tones of melody pattern play are assigned to a melody channel designated by pattern channel pointer RCHPT (steps U8 and U9).

In this way, melody tones of the melody pattern can be assigned to channels for the keyboard to make effective use of the channels.

Taking the first tone C4 of melody 1 as an example, since melody 1 belongs to the 1st channel "1 (0001)", "0 (0000)" is set in pattern channel pointer RCHPT, so that the melody tone of C4 is assigned to the 5th channel.

If the pitch data is key "off" data (step U4), CPU 9 tuns off the sounding of a melody tone assigned to the channel designated by pattern channel pointer RCHPT (steps U5 and U6).

When a key operation on keyboard 5 is detected in step U1, CPU 9 calls a channel, e.g., the 4th channel, designated by keyboard channel pointer CHPT (step U10). If data to be assigned is key "on" data (step U11), the CPU checks whether the 4th channel is idle (step U12). If the 4th channel is busy, the CPU increments data "3" of channel pointer CHPT to "4" (step U13). The 5th and following channels are not assigned to melody pattern play. Thus, channel pointer CHPT is cleared to "0", the 1st channel is designated (steps U14 and U15), and a check is done as to whether channel calling has been done for all the 4 channels (step U16). Since channel calling for the 4th channel has been done only once, the routine goes back to step U10 to effect idle channel search in the same manner as for the 1st channel designated by channel pointer CHPT in steps U10 to U16. Steps U10 and U16 are repeated for idle channel search for the 2nd and 3rd channels.

If an idle channel is detected in step U12, CPU 9 assigns a melody tone to a channel designated by channel pointer CHTP (steps U19 and U20) and increments channel pointer CHPT by 1. If channel pointer is incremented to "4", the CPU returns it to "0" (steps U26 and U27).

If no idle channel can be found by executing steps U10 to U16 for channel search in the four channels, the CPU forcibly turns off the melody tone of the channel next to the first-searched channel among the four channels (steps U17 and U18) and assigns the melody tone to this channel (steps U19 and U20). This is done because the next channel is the oldest channel to which melody tone has been assigned, due to the fact that melody tones are sequentially assigned to the channels in the order of increasing channel number.

If key "off" data is assigned in step U11, CPU 9 effects a progressive search for channels for which the same key code as the melody tone has been assigned (steps U21, U22, U10 and U11). If the same key code is detected, the melody tone assigned to the channel is turned off (steps U23 and U24) to update the designated channel in steps U25 to U27.

In the above way both the melody tones of the melody patterns and melody tones played on keyboard 5 may be assigned to keyboard channels.

The stored rhythm and melody pattern data may be reset by simultaneously depressing synchro key 3 and start/stop key 4. As a result, CPU 9 clears timing counter CTM, rhythm counters RC (1) to (4) and melody counters MC (1) to (4), sets "01" in channel register TCH and clears trigger map 18, melody pitch area 20 and rhythm tone color area 21.

The number of addresses of trigger map 18, the number of channels, and the kinds of rhythms and melodies described above are by no means limitative. Also, means for providing rhythm and melody patterns may be other than keyboard 5 and melody tone color select keys 6, so long as pattern data can be input. Further, it is possible to make use of a liquid crystal display, a CRT, etc., as well as LEDs, as sounding timing display means. Further, it is possible to assign rhythm tones of rhythm pattern to musical tone generation channels for the keyboard. Further, it is possible to provide a different number of channels than 4 for assignment.

As has been described in the foregoing, according to the invention, a melody pattern is input together with a rhythm pattern, and the rhythm and melody patterns are stored as a single rhythm pattern to be played. Thus, melody tones can be sounded as part of constituent tones of the rhythm pattern. Thus, it is possible to effect performances rich in variety, in addition to mere synchronization of the rhythm and melody patterns. Besides, it is possible to set desired rhythm and melody patterns, so that it is possible for the player to create a desired rhythm and melody. Further, it is possible to play a melody on the keyboard separately from the pattern play. The number of melody tones which are simultaneously sounded thus can be increased, so that it is possible to provide performances rich in a musical sense. Further, rhythm or melody patterns can be selectively masked, so that it is possible to listen only to selected rhythm or melody tones. It is also possible to confirm preset rhythm or melody patterns one by one. It is thus possible to readily set and edit rhythm and melody patterns. Further, since the timing of sounding of a rhythm or melody tone of a rhythm or melody pattern is displayed, it is possible to visually confirm the status of sounding of the rhythm or melody pattern. Further, it is possible to easily play the keyboard in a timed relation to the play of a rhythm or melody pattern. Further, it is possible to input a rhythm or melody pattern while confirming part of the pattern that has already been input on display means, whereby the pattern can be very easily input. Further, since rhythm tones of rhythm patterns or melody tones of melody patterns are assigned to musical tone generation channels for the keyboard, it is possible to effectively use the channels as a whole.

What is claimed is:

1. An electronic musical instrument comprising:

rhythm pattern input means for inputting a rhythm play pattern;

melody pattern input means for inputting a melody play pattern;

pattern memory means for storing said rhythm and melody patterns from said rhythm and melody pattern input means as a single rhythm pattern of desired measure such that said rhythm and melody play patterns are in a timed relation to each other;

readout means for simultaneously and repeatedly reading out said rhythm and melody play patterns from said pattern memory means; and rhythm and melody tone generating means for generating rhythm and melody tones according to said rhythm and melody play patterns read out from said pattern memory means by said readout means.

2. An electronic musical instrument comprising:

rhythm pattern input means for inputting a rhythm play pattern;

melody pattern input means for inputting a melody play pattern;

pattern memory means for storing said rhythm and melody play patterns from said rhythm and melody pattern input means as a single rhythm pattern of desired measure such that said rhythm and melody play patterns are in a timed relation to each other;

readout means for simultaneously and repeatedly reading out said rhythm and melody play patterns from said pattern memory means;

rhythm and melody tone generating means for generating rhythm and melody tones according to said rhythm and melody play patterns read out from said pattern memory means by said readout means; and sound inhibiting means for selectively inhibiting said rhythm and melody tones generated by said rhythm and melody tone generating means from being sounded.

3. An electronic musical instrument comprising:

rhythm pattern input means for inputting a rhythm play pattern;

melody pattern input means for inputting a melody play pattern;

pattern memory means for storing rhythm and melody patterns from said rhythm, and melody pattern input means as a single rhythm pattern of desired measure such that said rhythm and melody play patterns are in a timed relation to each other;

readout means for simultaneously and repeatedly reading out said rhythm and melody play patterns from said pattern memory means;

display means for displaying the timing of sounding each rhythm or melody tone of said rhythm or melody play pattern read out from said pattern memory means by said readout means; and rhythm and melody tone generating means for generating rhythm and melody tones according to said rhythm and melody play patterns read out from said pattern memory means by said readout means.

4. An electronic musical instrument comprising:

a keyboard adapted for generating a plurality of melody tone signals;

a plurality of musical tone generation channels, to which a plurality of melody tone signals from said keyboard are assigned for polyphonic sounding of melody tones;

rhythm pattern input means for inputting a rhythm play pattern;

melody pattern input means for inputting a melody play pattern;

pattern memory means for storing said rhythm and melody play patterns from said rhythm and melody play pattern input means as a single rhythm pattern of desired measure such that said rhythm and melody play patterns are in a timed relation to each other;

readout means for simultaneously and repeatedly reading out said rhythm and melody play patterns from said pattern memory means; and channel assigning means for assigning rhythm or melody tone signals according to said rhythm or melody play pattern read out from said pattern memory means to said plurality of musical tone generation channels.

* * * * *